United States Patent [19]

Blomberg

[11] 4,151,727

[45] May 1, 1979

[54] ASSEMBLY FOR SEPARATING ICE CUBES

[75] Inventor: Peter E. Blomberg, Stockholm, Sweden

[73] Assignee: Aktiebolaget Electrolux, Stockholm, Sweden

[21] Appl. No.: 827,849

[22] Filed: Aug. 26, 1977

[30] Foreign Application Priority Data

Aug. 27, 1976 [SE] Sweden ..... 7609525

[51] Int. Cl.[2] ..... F25C 5/10; F25C 15/10

[52] U.S. Cl. ..... 62/352; 62/492

[58] Field of Search ..... 62/142, 148, 238, 277, 62/349, 352, 337, 492, 495

[56] References Cited

U.S. PATENT DOCUMENTS

| | | | |
|---|---|---|---|
| 2,241,624 | 5/1941 | Smellie | 62/349 |
| 2,255,413 | 9/1941 | Coons | 62/349 |
| 2,296,879 | 9/1942 | Smellie | 62/349 |
| 2,410,334 | 10/1946 | Brace | 62/352 |
| 2,700,280 | 1/1955 | Heuser | 62/352 |
| 2,743,588 | 5/1956 | Dreier | 62/492 |
| 3,206,945 | 9/1965 | Nilsson et al. | 62/352 |

*Primary Examiner*—Lloyd L. King
*Attorney, Agent, or Firm*—Alfred E. Miller

[57] ABSTRACT

An ice cube freezing arrangement in an absorption type refrigerator having conduit means conducting hot vapors from a vapor conduit leading from the boiler system to the ice dividing walls and tray for ice cubes. The vapor conduit is normally blocked but opened occasionally in order to release the ice cubes from its tray.

11 Claims, 7 Drawing Figures

ASSEMBLY FOR SEPARATING ICE CUBES

BACKGROUND OF THE INVENTION

It is known in absorption type refrigerating apparatus to make ice in one or several ice trays, which after freezing contain a relatively large frozen body comprising pieces of ice separated from one another by dividing walls which adhere to the body. When it is desired to remove an ice cube or cubes, the ice tray must be taken out from the refrigerator and the cubes separated from one another and from the dividing walls and the ice tray. It is well known that it is often rather difficult to free the cubes from the tray. There are ice trays of a design which make the ice less difficult to handle, but in those cases, as a rule, one receives a very small quantity of ice. Although several trays can be used for the making of ice cubes, usually the space in a refrigerator is occupied by other things so that there is room for only one ice tray. It is also known that ice cubes are not needed continuously, but although some time may pass between the occasions when ice is needed and removed; when ice is needed only one ice tray is generally available. Often, however, it is desired to use more ice than the quantity that can be held in a single ice tray, and on those occasions it is desirable to have ice available in the form of ready, separated ice cubes. It is, of course, possible to make ice in several trays, but with an absorption refrigerating apparatus it is also desired not to load the apparatus by freezing too large a quantity of water on the same occasion, since this would to some extent affect cooling of other items in the refrigerator. Therefore, it would be of considerable advantage to have a more or less continuous freezing and removal of a small quantity of ice, which processes could be repeated. This method is known in connection with compressor operated refrigerators but in absorption type refrigerating apparatus it has not yet been successfully accomplished although U.S. Pat. No. 2,743,588 is directed to a means for electric heating of an ice cube tray in an absorption refrigerating apparatus.

SUMMARY OF THE INVENTION

The present invention relates to an arrangement in an absorption refrigeration apparatus for making ice cubes in a continuous process, and an assembly for separating the ice cubes from their trays from time to time.

It is an object of the present invention to freeze and separate ice cubes from a tray in the freezing compartment of an absorption refrigerator. In this connection, the ice separating assembly includes a conduit which intermittently conducts part of the hot working media of the refrigerating apparatus in contact with the ice cube making facility. The conduit is provided with blocking means in the heat-conductive connection to said ice cube making facility.

An object of the present invention is to provide a siphon for establishing occasional heat transfer between the boiler system and the ice dividing wall of the ice tray, and to have a condensate collecting sump which co-acts with the siphon to commence a heat supply to the ice dividing wall at any given time. The dimensions of the sump and siphon are such that heating of the dividing wall occurs at suitable times and during a period sufficient for the purpose.

The invention will now be more fully described with reference to the accompanying drawings, in which.

DESCRIPTION OF THE PREFERRED EMBODIMENTS

Figure 1:
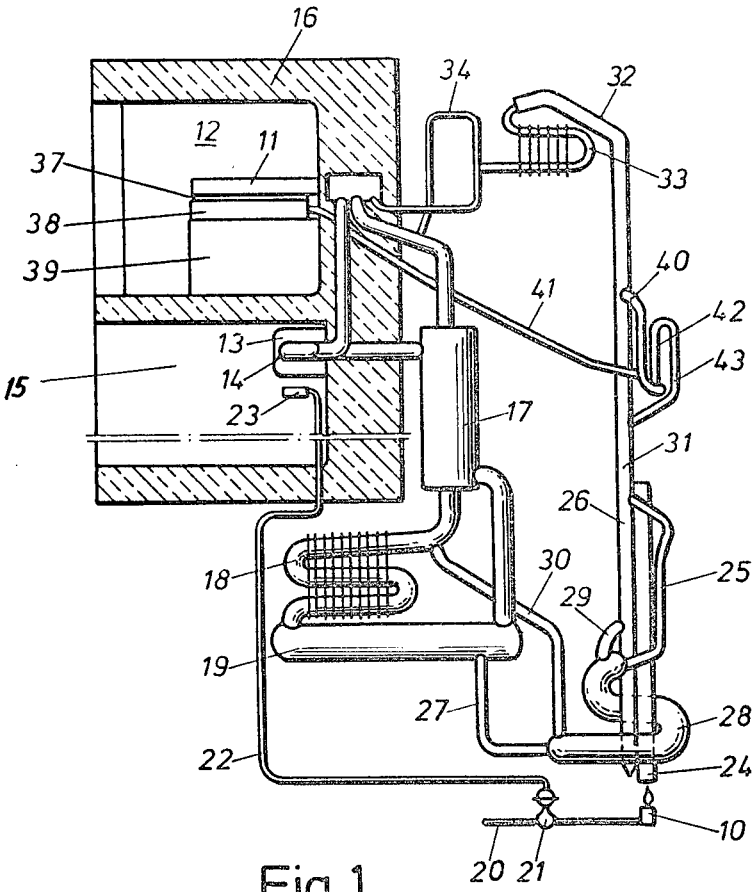
FIG. 1 is a diagrammatic view of a refrigerator of the absorption refrigerating type having means for making ice cubes and an ice cube separating assembly.

The refrigerator, as shown in FIG. 1, is an absorption refrigerating apparatus operated by a gas burner 10. The apparatus contains a pressure equalizing gas, for example hydrogen. Water and ammonia may be used as the absorption medium and the refrigerant medium, respectively. The apparatus has one pipe coil forming a low temperature evaporator 11 in a freezing compartment or chamber 12, and another pipe coil having fins 13 which form a higher temperature evaporator 14 positioned in a chamber 15 and operating at a higher temperature in a cabinet 16, whose door is not shown. The evaporators 11 and 14 are both included in the gas circulation system of the apparatus, and the system, which is known, also includes conduits, a gas heat exchanger 17, an absorber 18, and an absorber vessel 19.

As seen in FIG. 1, the gas burner 10 is connected to a gas conduit 20 by a thermostat 21 connected by an impulse conduit 22 to a sensor 23 in the cooling chamber 15. The burner 10 discharges hot gases through a flue 24 which is heat-conductively connected to a liquid circulation pump 25 and a boiler 26.

A solution, rich in ammonia, is conducted from the absorber vessel 19 through a conduit 27 and a liquid heat exchanger 28 to the pump 25. This solution is lifted by the pump 25 while expelling ammonia vapor, and the weak solution is collected in the boiler 26 in which additional vapor is expelled. Thereafter the weak solution is conducted by a conduit 29, the liquid heat exchanger 28 and a conduit 30 to the absorber 18, through which it flows while absorbing ammonia vapor from the rising, rich gas mixture.

Vapors expelled in the pump 25 and the boiler 26 are conducted by way of a vapor conduit 31 to a water separator 32 and a finned condenser 33. The condensate of ammonia formed in the condenser is conducted by means of a conduit 34 into the low temperature evaporator 11, in which part of the condensate evaporates while generating cold. The remaining condensate is conducted to the higher temperature evaporator 14, thereby cooling the chamber 15.

Figure 2:
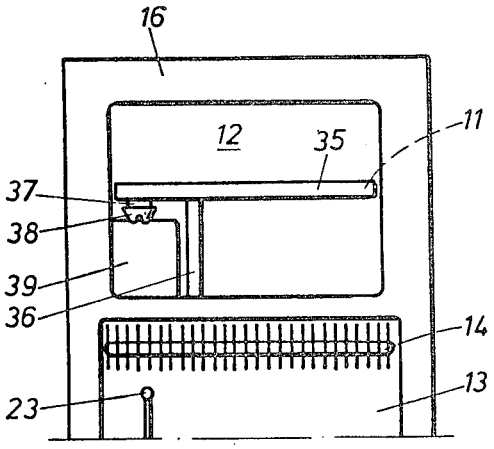
FIG. 2 is a front diagrammatic view of the upper part of the refrigerator.

It will be seen from FIG. 2, which shows a section of the refrigerator seen from the front, that in the freezing chamber 12 the evaporator coil 11 has a metal plate casing 35, which on one hand forms a surface-enlarging means for the evaporator 11, and on the other hand divides the chamber 12 into an upper and a lower part. The latter is divided by a vertical partition 36 into two spaces, in which the right space is intended for storing items to be frozen and the left space contains an ice dividing wall 37 disposed under the evaporator 11 and forming a cover for an ice tray 38. Under the tray 38 is a box 39 to collect ice cubes formed in the tray 38 and ejected therefrom.

Figure 3:
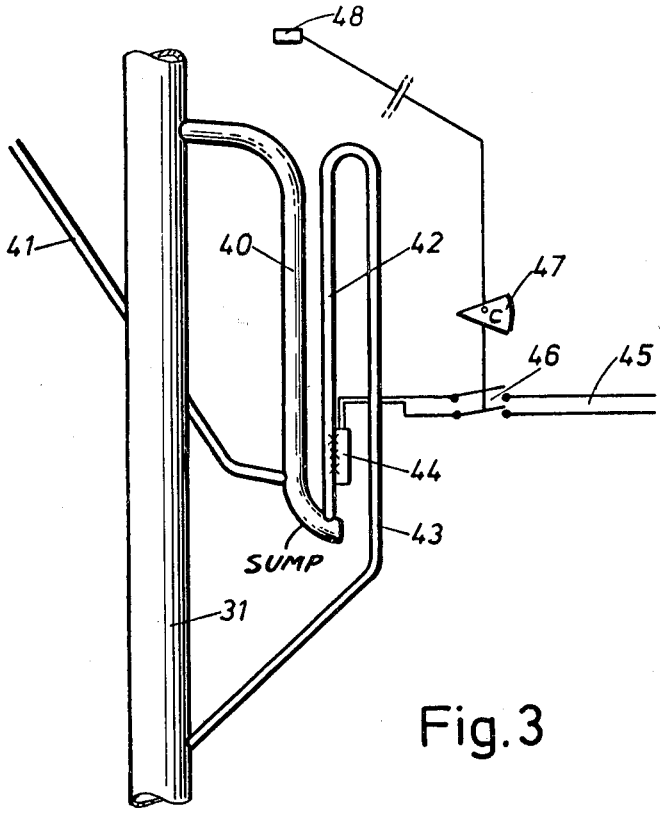
FIG. 3 is a diagrammatic view of a part of the vapor conduit of the refrigerating apparatus with means for supplying heat to the dividing wall of the ice cube tray.
Figure 4:
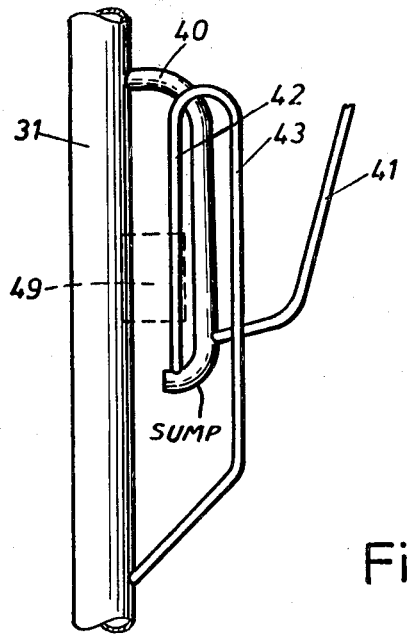
FIG. 4 is a diagrammatic view of a modification of the assembly shown in FIG. 3.

In accordance with the teachings of the present invention a connecting conduit 40, 41 is heat-conductively connected to an ice dividing wall located in the freezer ice tray. The conduit can be heat-conductively connected also to the higher temperature evaporator 14, but it is also possible to have a separate connecting conduit for defrosting this evaporator. As seen in FIGS. 3 and 4, the conduit is in known manner constructed to form a sump connected to the vapor conduit 31 in which refrigerant vapor condenses and is collected whereby the condensate blocks the way for vapor through the connecting conduit 40, 41. A siphon is connected by its short leg 42 to the lower part of the sump in the conduit part 40 and by its long leg 43 to the vapor conduit 31 in order to provide occasional heat transfer between the vapor space of the boiler system and the dividing wall 37. When the liquid in the sump of the known defrosting device has risen sufficiently, the siphon 42, 43 starts operation automatically and empties the liquid seal, which will remain open during a given time, depending on the time required for fresh supply of condensate to collect in the liquid seal in a quantity sufficient to close the above-mentioned connection.

When a connecting conduit of the type above described is used in the known manner to defrost an evaporator part, the device is generally adapted normally to cause defrosting to occur about once every 24 hours, and to last about 40 minutes. Correspondingly, the connecting conduit can be adapted to let through a desired quantity of heat to release ice from the dividing wall and the ice tray at suitable times. The time required for freezing water to ice in an ice tray can be established. On one hand it depends on the quantity of ice to be made, and on the other hand it depends on the capacity of transferring heat of the evaporator part used for the purpose. Thus, the dimensions of the sump and the siphon are such that heating of the dividing wall occurs at suitable times and during a period sufficient for the purpose. It is important, however, to see to it that heating does not occur before freezing of ice has been accomplished. It is less important if heating is delayed a small amount of time after freezing. The energy required for defrosting an evaporator part may vary from time to time, but the quantity of heat required for separation of ice from the dividing wall and tray is about the same each time.

According to the teachings of the present invention, it is possible to start the heat supply at any desired time. The sump and the siphon are not designed as in the known devices, in which the siphon starts after a given quantity of liquid has collected in the sump. Instead, these parts are made so that the liquid does not initiate emptying of the liquid seal, for example when the top of the siphon is higher than the sump. The siphon 42,43 starts operating by means of the supply of heat to the short leg 42, as shown in FIG. 3, in which the short leg is heat-conductively connected to an electric heating cartridge 44, the latter being connected to a source of energy (not shown) by way of conducting wires 45 through a thermostat 46 which by means of an impulse conduit 47 with a sensor 48 senses the temperature at the underside of the ice tray 38. However, a manually operated switch or an electric time switch can be used to achieve release of the ice at fixed times instead of the thermostat 46.

Another way of separating the ice cubes is shown in FIG. 4. In this embodiment the siphon is caused to start operating by a heat-conducting body 49, which is preferably of a wedge shape, and which is movable so that in its retracted position it has no influence on the apparatus, whereas in its normal position it forms a heat-conductive connection between the vapor conduit 31 and the short leg 42 of the siphon.

Figure 5:
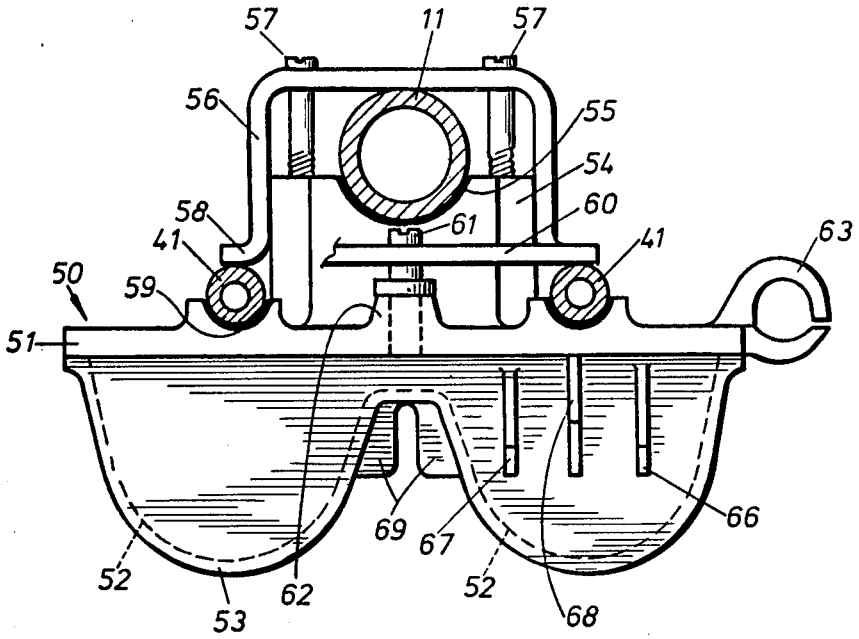
FIG. 5 is a front elevational view, partly in section, of the dividing wall and ice tray, and shows heat-conductive connections having pipes, from the refrigerating apparatus.
Figure 6:
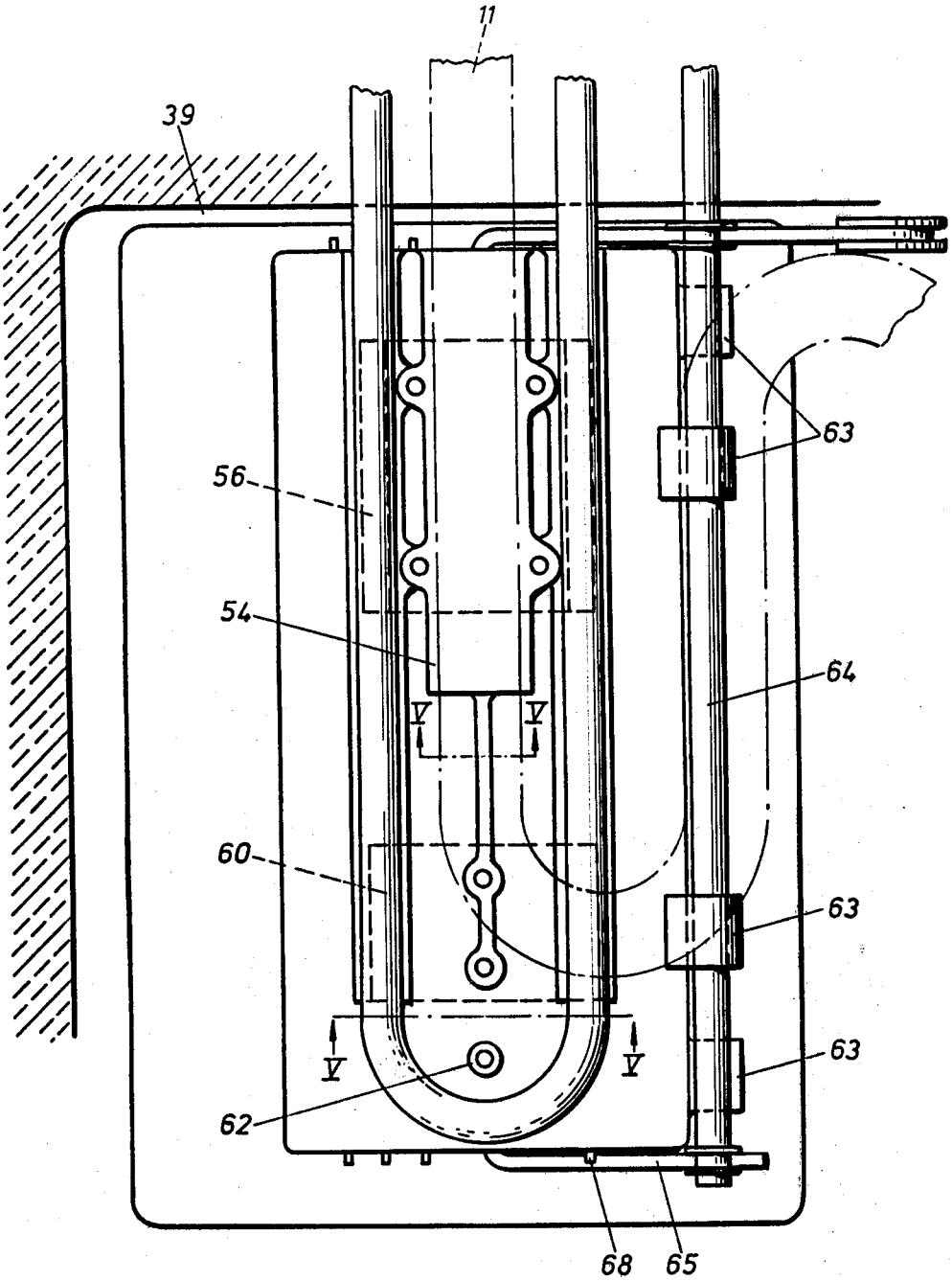
FIG. 6 is a top plan view showing the dividing wall shown in FIG. 5 placed in its location below the pipes, but without fastening plates.

It is known that absorption refrigerators have an ice tray with an ice dividing wall that is entirely separated from the refrigerator and is taken out of a freezing chamber when ice cubes are to be used. In the new device, the dividing wall 50 is instead attached in direct heat-conductive connection to a straight part of the low temperature evaporator 11, as seen in FIGS. 5 and 6. The dividing wall 50 is of heat-conducting material, for example, aluminum, and includes a plate 51 under which are two rows of fins 52 extending into an ice tray 53 fabricated of a suitable material. The dividing wall has upwards extending means for heat-conductive contact with both the evaporator part 11 and the vapor conduit 41. The dividing wall 50 has a rear part 54 which is relatively high and has a cylindrical recess 55, which corresponds to the outer form of the evaporator pipe 11. Over the wall 50 is located a yoke 56, and screws 57 by which the wall is securely mounted under the evaporator pipe 11 and is kept pressed thereto in good heating conductive contact. The pressure areas of the yoke 56 are formed by edge portions 58 bent into another plane and abutting the U-shaped vapor conduit 41. Its bottom part in FIG. 5 lies in front of the figure, and in FIG. 6 it is cut away on the line V–V. The dividing wall 50 has a U-shaped recess 59 corresponding to the form of the vapor conduit 41. In front of the dividing wall part 54, which is heat-conductively connected to the evaporator pipe 11, a metal plate 60 is placed over the vapor conduit 41, which is clamped between the dividing wall 50 and the plate 60 by means of screws 61.

As seen in FIG. 6, a nipple 62 is positioned ahead of the plate 60. Thus, the dividing wall 50 has a nipple 62 with connecting means to a conduit for the supply of water to the ice tray.

As seen in FIGS. 5 and 6, the dividing wall 50 is provided with lugs 63 for a shaft 64 that supports a wire bracket 65 extending over shoulders 66,67 and under a shoulder 68 of the end piece of the ice tray 53. From there the bracket extends under the tray in a guide between wings 69 and behind the ice tray back to a pivot arrangement.

Figure 7:
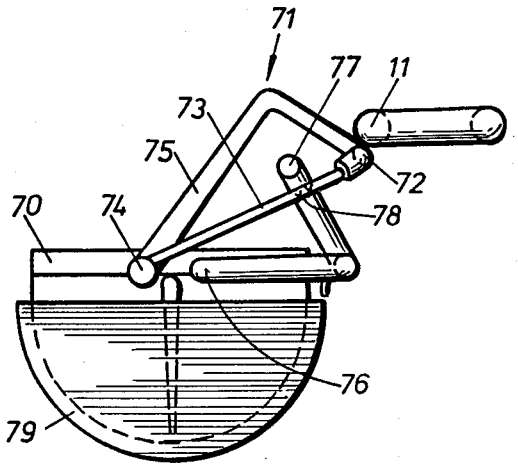
FIG. 7 is a diagrammatic view of a modification of the invention provided with a dividing wall which is connected to the evaporator of the refrigerating apparatus by way of a secondary system.

In FIG. 7 an assembly is shown diagrammatically in which the dividing wall 70 is heat-conductively connected to the evaporator 11 by way of a secondary system 71 operating with condensation and evaporation. This system includes a part 72 which is positioned parallel to, and heat-conductively connected to the evaporator 11. The refrigerant enclosed in the system in part 72 condenses and flows through a conduit 73 to an evaporation part 74, which is heat-conductively connected to the dividing wall 70. The refrigerant vapor is returned to the condensation part 72 by way of a conduit 75.

A vapor conduit extends from the boiler system of the apparatus which can be opened occasionally and has a part 76 in heat-conductive connection with the dividing wall 70. After having passed the part 76 the vapor is conducted through conduit 77 to the higher temperature evaporator near the refrigerating apparatus. The vapor conduit 77 is heat-conductively connected to the condensate conduit 73 of the secondary system 71 by a weld 78 or in another suitable means.

When the ice cubes are to be freed, vapor is let through the vapor conduit 76, 77, thus heating the part 76 thereof which is heat-conductively connected to the dividing wall. When the dividing wall is heated, the ice cubes below are released from it and also from the ice tray 79, which is movably arranged under the dividing wall. As long as the vapor conduit is open, the condensate conduit 73 is affected through the heat-conductive connection 78 in such a way that no condensate reaches the evaporation part 74 in the secondary system, and thus transfer of heat from the dividing wall ceases occasionally while ice is being released.

It is intended that the invention should not be limited to what has been illustrated in the drawings and described above, but can be modified in many ways within the spirit and scope of the following claims.

What is claimed is:

1. A continuous absorption refrigeration apparatus having a condenser, a boiler system with hot working media and vapor thereof and a freezing section for ice cubes in a tray comprising: means for releasing said ice cubes from said tray including a conduit bypassing said condenser for drawing off vapor from the boiler system, said conduit being provided with blocking means that normally prevents the drawing off of said vapor but occasionally releases said blocking means to permit said vapor to pass through and condense in said conduit, the latter being arranged in heat conductive contact with said ice cube tray.

2. The combination as claimed in claim 1 wherein said heat conductive arrangement comprises ice-dividing fixed walls extending downwardly therefrom in a generally vertical plane, and said ice tray being mounted under said freezing plate for movement between a freezing position and an emptying position, and said branch conduit being heat conductively connected to said freezing plate.

3. The combination as claimed in claim 2 wherein said refrigeration apparatus is provided with an evaporator, and a main conduit carrying vapor from the boiler system and extending from said boiler system to said condenser from which condensate is fed to said evaporator, and said bypass conduit coming off said main conduit.

4. The combination as claimed in claim 2 wherein said freezing section is provided with an evaporator having a pipe, and said freezing plate having contact surfaces which abut at least part of said branch conduit that supplies heat and said pipe of the evaporator which carries off heat.

5. The combination as claimed in claim 3 wherein said vapor branch conduit is provided with said blocking means including a sump for collecting condensate, and a siphon for connecting said sump to the main conduit of said boiler system.

6. The combination as claimed in claim 5 further comprising heating means operatively connected to said siphon wherein said sump and siphon co-act so that the siphon is caused to operate by means of an occasional supply of heat thereto from said heating means.

7. The combination as claimed in claim 6 wherein said heating means is movable between heating and non-heating positions, and in said heating position a heat transfer is provided between said main vapor conduit to a short leg of said siphon.

8. The combination as claimed in claim 6 in which said heating means is a heating cartridge that is heat conductively connected to the short leg of said siphon.

9. The combination as claimed in claim 6 further comprising a temperature controlled means provided with a sensor and connected to said freezing plate, said means controlling the supply of heat to said siphon.

10. The combination as claimed in claim 8 further comprising a thermostat having a sensor connected to said freezing plate, and said heating cartridge in heat conducting relationship with said siphon is connected to a source of energy by means of said thermostat and sensor.

11. The combination as claimed in claim 3 further comprising a freezing plate, a secondary system having an evaporation part, said secondary system operating with evaporation and condensation, said freezing plate being in heat conducting relationship with said evaporation part, the condensation part of the secondary system being in heat conductive connection with the evaporator of the refrigerating apparatus, and a vapor conduit being arranged in heat conductive contact with said secondary system which conducts condensate from the condensation part to said evaporation part, said vapor conduit being adapted to occasionally transfer heat to said freezing plate.

* * * * *